US005475412A

United States Patent [19]

Wong

[11] Patent Number: 5,475,412

[45] Date of Patent: Dec. 12, 1995

[54] SHEET MEDIA MARKING SYSTEM

[75] Inventor: Chee W. Wong, Singapore, Singapore

[73] Assignee: Hewlett-Packard Company, Palo Alto, Calif.

[21] Appl. No.: 202,420

[22] Filed: Feb. 28, 1994

[51] Int. Cl.[6] ..... B41J 2/01; B41J 13/00

[52] U.S. Cl. ..... 347/104; 271/277; 346/138; 347/37; 400/659

[58] Field of Search ..... 347/104, 37, 218; 400/659, 602; 346/138; 271/277, 82

[56] References Cited

U.S. PATENT DOCUMENTS

| | | | |
|---|---|---|---|
| 2,976,108 | 3/1961 | Johnson | 346/138 X |
| 3,854,563 | 12/1974 | Cowardin et al. . | |
| 4,538,933 | 9/1985 | Imaizumi et al. | 400/582 |
| 4,591,281 | 5/1986 | Howard | 347/104 X |
| 4,990,933 | 2/1991 | Hatakeyama et al. | 347/218 X |
| 5,121,139 | 6/1992 | Burke | 347/104 X |
| 5,402,156 | 3/1995 | Donahue | 347/37 X |

*Primary Examiner*—Joseph W. Hartary

[57] ABSTRACT

The invented sheet media marking system provides a platen which is configured to rotate a sheet of medium about a marker so as to accommodate marking of the sheet. The platen preferably takes the form of a rotatable drum, the interior of which supports the sheet at a predetermined distance from the printhead which is suspended within the drum. A printhead support is used to hold the printhead in a fixed rotational orientation relative to the platen's axis of rotation, each rotation passing the sheet across the printhead for marking thereof in a swath of print. The sheet is advanced using a medium advancing mechanism which directs movement of the sheet along the interior surface of the drum.

15 Claims, 4 Drawing Sheets

SHEET MEDIA MARKING SYSTEM

TECHNICAL FIELD

The present invention relates generally to marking systems, and more particularly, to a sheet media marking system which employs a platen capable of rotating sheet media about a printhead. This is accomplished through the use of a rotatable drum, the interior of which serves as the platen to support a sheet for marking by a printhead contained within the drum. Those skilled will appreciate that the invented marking system has broad utility, being useful in the context of various marking apparatus, including apparatus such as ink printers, laser printers, copiers, or virtually any other apparatus wherein markings are to be produced on a sheet. In the interest of brevity, however, the invented system is described herein only in the context of an ink-jet printer, an apparatus in which it is believed to be particularly useful.

BACKGROUND ART

In a conventional ink-jet printer, ink is deposited on a sheet medium via a reciprocating printhead which is configured to propel ink onto the sheet as it passes thereacross. Sheets are fed through the printer using a roller (or belt) arrangement, the arrangement generally being designed to pull consecutive sheets from an adjacent input tray. Each sheet is directed along a feed path to a platen which supports at least a portion of the sheet at a predetermined distance from the printhead. The printhead is driven across the surface of the sheet, producing markings on the sheet in a swath defined by movement of the printhead. Upon completion of such a print swath, the sheet is advanced by the roller arrangement, positioning the sheet for acceptance of a new print swath. Once printed, sheets are expelled to an output tray.

Although printer designs of the type just described are effective, there remains room for improvement. Designers have, for example, long sought ways to increase the rate of sheet media throughput without decreasing the quality of print. These designers generally have focused on increasing the accuracy of ink placement, overlooking the loss of time which is inherent in each reciprocation of the printhead. Those skilled will appreciate that such printhead reciprocation involves repeated changes in the direction of printhead travel, and thus repeated braking and accelerating of the printhead. This in turn leads to less than optimal power utilization, and to undesirable vibration and noise. It is therefore a general object of this invention to provide a system which minimizes reciprocation of the printer's printhead. More specifically, the invention is intended to provide for increased sheet media throughput, improved utilization of power, and decreased vibration and noise relative to printers which are now known.

DISCLOSURE OF THE INVENTION

The invented sheet media marking system addresses these problems by providing a sheet-supporting platen configured to rotate a sheet about the system's printhead (or marker) during marking of a sheet medium. The preferred platen is in the form of a rotatable drum, the interior of which supports the sheet. The system's printhead is suspended within the drum, a printhead support being used to hold the printhead in a fixed rotational orientation relative to the axis of rotation of the drum. Each rotation of the drum passes the sheet medium across the printhead for marking in a swath of print. In the preferred embodiment, the printhead support provides for graduated linear movement of the printhead along a track which is parallel to the drum's axis of rotation, each such graduated movement placing the printhead in a different rotational plane so as to provide for a separate, rotationally-defined print swath.

In the preferred embodiment, the drum defines a slot through which sheet media is inserted and expelled, the slot being positioned by rotation of the drum to either pick-up a sheet from an adjacent input tray, or to expel a sheet to an adjacent output tray. Such insertion and expulsion is achieved using a medium advancing mechanism which includes a grip member coupled with a system chassis via a bearing arrangement. The grip member includes a shoe adapted to direct movement of a sheet medium along the interior surface of the drum, the shoe being configured to engage either a leading or trailing edge of the sheet. The shoe moves in either a first or second direction, movement of the shoe in the first direction resulting in insertion of a sheet, and movement of a shoe in the second direction resulting in expulsion of the sheet. During rotation of the drum, the sheet is held against the interior surface of the drum by the grip member which urges the leading edge of the sheet against an opposing stop.

DETAILED DESCRIPTION OF THE PREFERRED EMBODIMENT AND BEST MODE FOR CARRYING OUT THE INVENTION

Figure 1:
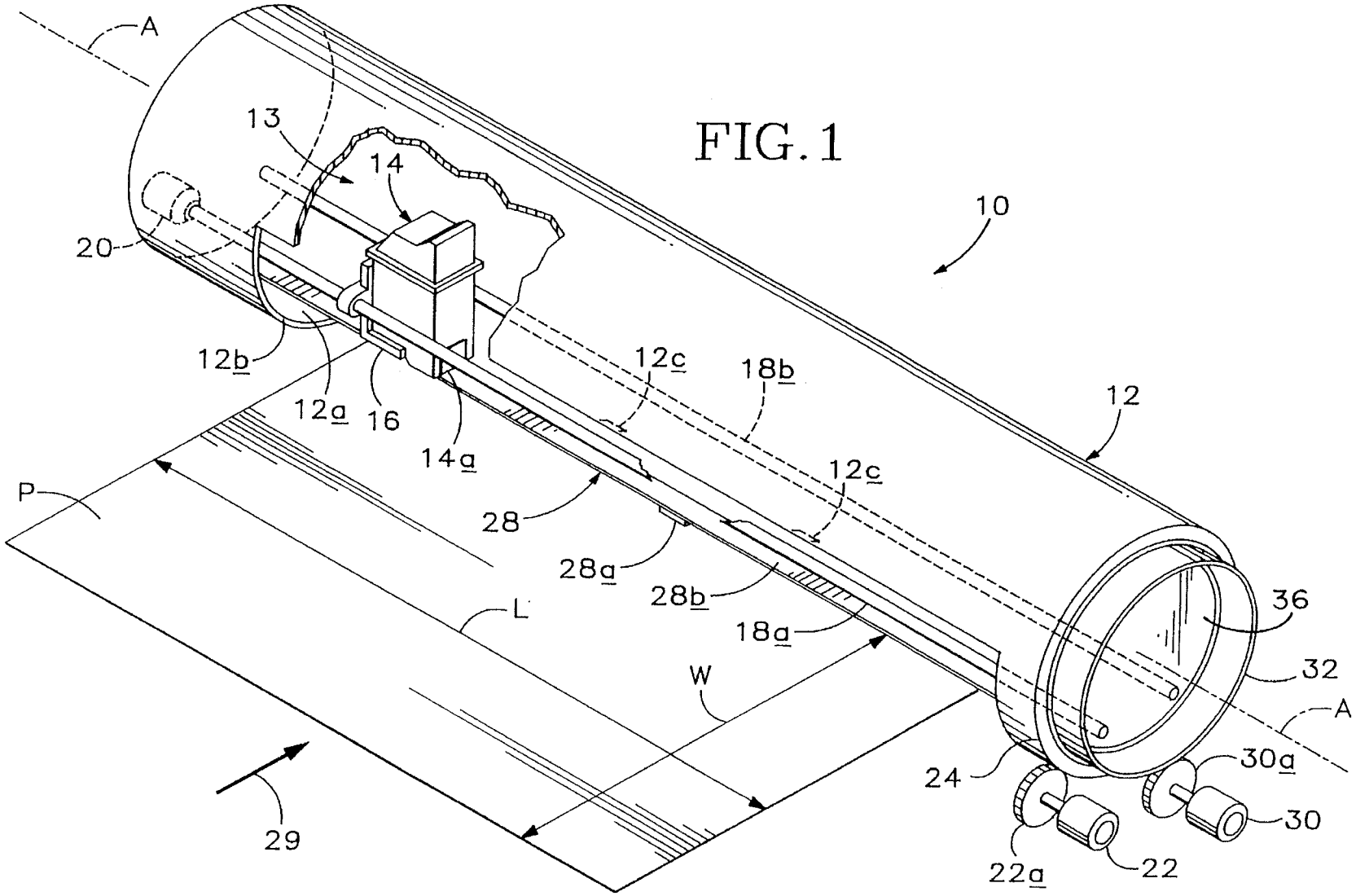
FIG. 1 is a simplified isometric view of the invented sheet media marking system, the system being shown during pick-up of a sheet medium, and being fragmented to better illustrate the components of the system as claimed.

Referring initially to FIG. 1, the reader will note that a preferred embodiment of the invented sheet media marking system has been depicted, the invented system being indicated generally at 10. System 10 is intended for use in connection with the marking of sheet media, the system being configured to mark individual sheets of a medium such as that shown at P. Those skilled in the art will recognize that sheet P may be considered to represent virtually any type of record medium, but that the sheet will commonly take the form of a letter-size paper sheet. Operation of the preferred embodiment system is thus described below in connection with a conventional letter-size sheet, the sheet having a length L of approximately 11-inches and a width W of approximately 8½-inches.

Pursuant to the present invention, system 10 will be seen to include a drum 12 which is configured for rotation about a central axis A. As indicated, drum 12 defines an interior chamber 13 in which a printhead 14 is housed. The printhead is mounted on a printhead support which includes a carriage 16 and a pair of elongate rods 18*a*, 18*b*. Like the printhead, the printhead support resides within the drum, the support being arranged to maintain a predetermined distance between the printhead's printing surface 14*a* and the drum's interior surface 12*a*. An elongate slot 12*b* is formed in the drum to provide for insertion of a sheet medium such as paper sheet P. The sheet is taken in along the drum's interior surface, such surface being capable of supporting the sheet at a predetermined distance from the printing surface of the printhead. Interior surface 12*a* is thus well suited for use as a platen, and is used as such during the marking of sheets by system 10.

Focusing now specifically on drum 12, the reader will note that the drum preferably takes the form of an elongate cylinder, such cylinder having a length which is greater than the maximum length of the to-be-printed sheet. The drum's slot 12*b* similarly has a length which is greater than the maximum sheet length, accommodating sideways insertion of sheets in the manner illustrated by FIG. 1. To insert a sheet, the sheet is passed along a path defined by interior surface 12*a*, such surface preferably being smooth so as to minimize resistance to passage of the sheet. Surface 12*a* is generally arcuate, and is preferably semi-circular, providing a platen which is uniformly spaced from its axis of rotation A. The importance of such uniformity will be appreciated upon reading further.

As previously indicated, system 10 includes, as one of its principal components, a printhead 14 which is suspended within drum 12 for use in marking a sheet which is held against the interior surface of the drum in a manner which will be described below. In the preferred embodiment, the printhead takes the form of a conventional ink-jet printhead, but those skilled in the art will appreciate that virtually any marker which is capable of producing markings on a sheet of medium may be used. Substitutes for printhead 14 may, for example, include laser or thermal printheads. The marker is generally operated under the control of an onboard processor (not shown) which directs firing of the printhead in a manner which is well known in the art.

Figure 2:
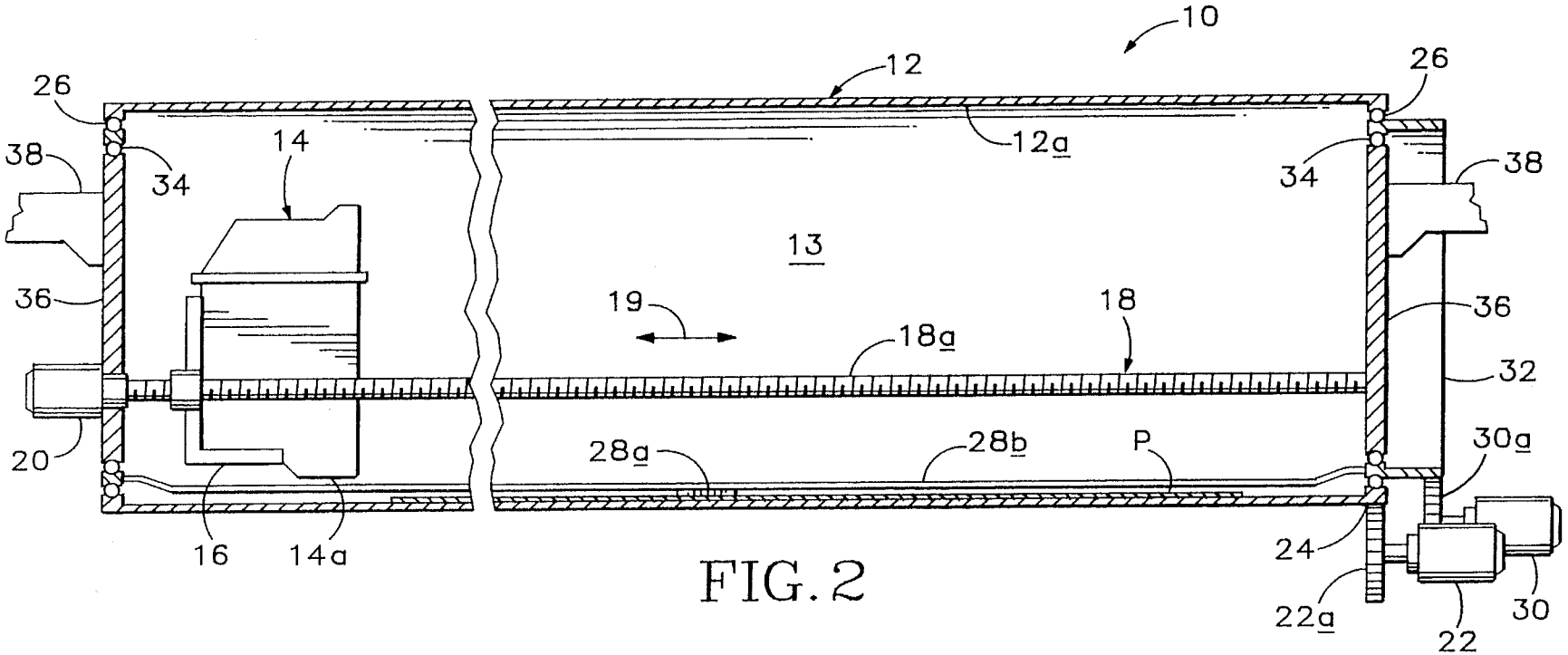
FIG. 2 is a sectional elevational view of the system shown in FIG. 1, the section being taken generally along a plane which passes through an axis of rotation of the system's rotatable drum.

Referring now to FIGS. 1 and 2, it will be appreciated that printhead 14 is movable along an axis which is parallel to axis A, such printhead movement being illustrated by the change in printhead position from FIG. 1 to FIG. 2. As indicated, the printhead is mounted on a carriage 16 which in turn is mounted for movement along a track (indicated generally at 18). In its preferred form, track 18 is defined by a pair of elongate rods 18*a*, 18*b*, the rods extending in parallel fashion along the interior of the drum. Carriage 16 is configured to controllably ride along the rods, while maintaining the printhead in a predetermined rotational orientation relative to axis A. Although two rods are shown, those skilled in the art will appreciate that virtually any style or number of rods may be used as long as such rods provide stable support for the printhead.

As illustrated in FIG. 2, printhead movement preferably occurs via a screw drive which forms a part of the system's printhead support. The depicted screw drive provides for bidirectional movement of the printhead (as indicated at 19), the printhead being movable in a series of graduated steps along track 18. Each such step accommodates printing in a separate print swath, the drum being rotated past the printhead in a manner which will be described further below. In the preferred embodiment, the screw drive includes a stepper motor 20 which drives threaded rod 18*a* through a threaded aperture in carriage 16. Rotation of the rod is effective to pass the carriage (and thus the printhead) along the track. Rod 18*b* is preferably smooth, providing for sliding passage of the carriage without rotation of the printhead.

Turning now to the operation of drum 12, it is to be recalled that the drum is configured for rotation about axis A, such rotation being directed by a processor-controlled drive motor 22. Motor 22 will thus be understood to act as a platen drive (or drum drive), the drive being operatively coupled with the drum via a gear arrangement such as that represented by frictional gear 22*a*. Gear 22*a* operates by engagement with the drum's exterior surface 24, rotation of the gear being effective to produce corresponding rotation of the drum. As indicated in FIG. 2, drum movement is accommodated by bearings 26 which preferably take the form of ball bearings. It will be appreciated, however, that any style bearing may similarly be used, including conventional slide bearings. Motor 22 may similarly take a variety of forms, but preferably will take the form of a reversible stepper motor so as to accommodate graduated, bidirectional rotation of the drum.

During a given print cycle, sheet P proceeds through the invented system along a predetermined sheet path, the sheet being carried along the path by a sheet advancing mechanism which includes a sheet-gripping member such as that shown at 28. The sheet-gripping member (or grip member) pulls the entire sheet into the drum, the sheet generally being pulled in the direction indicated by arrow 29 in FIG. 1. As indicated above, the sheet preferably is pulled into the drum along its width, rather than its length, making it possible to support the entire sheet with a smaller drum than would be necessary if the sheet was pulled in along its length (width (W) is shorter than length (L)). This arrangement also affords printing in rows without reciprocation of the printhead. If the sheet were inserted lengthwise, printing would occur in columns rather than rows, an unconventional arrangement which nevertheless is within the spirit and scope of the invention.

Because the to-be-printed sheet is supported against the drum's interior surface, and because the drum rotates, the sheet is continuously rotated about the system's printhead, each revolution defining a print swath across the sheet's width. To define a different print swath, the printhead is simply moved along track 18, each such movement accommodating a separate rotationally-defined swath. There is no need to reciprocate the printhead, except upon completing printing of a sheet. Acceleration and deceleration of the printhead is thus minimized, leading to increased printer throughput, decreased power requirements, and decreased vibration and noise.

Figure 3:
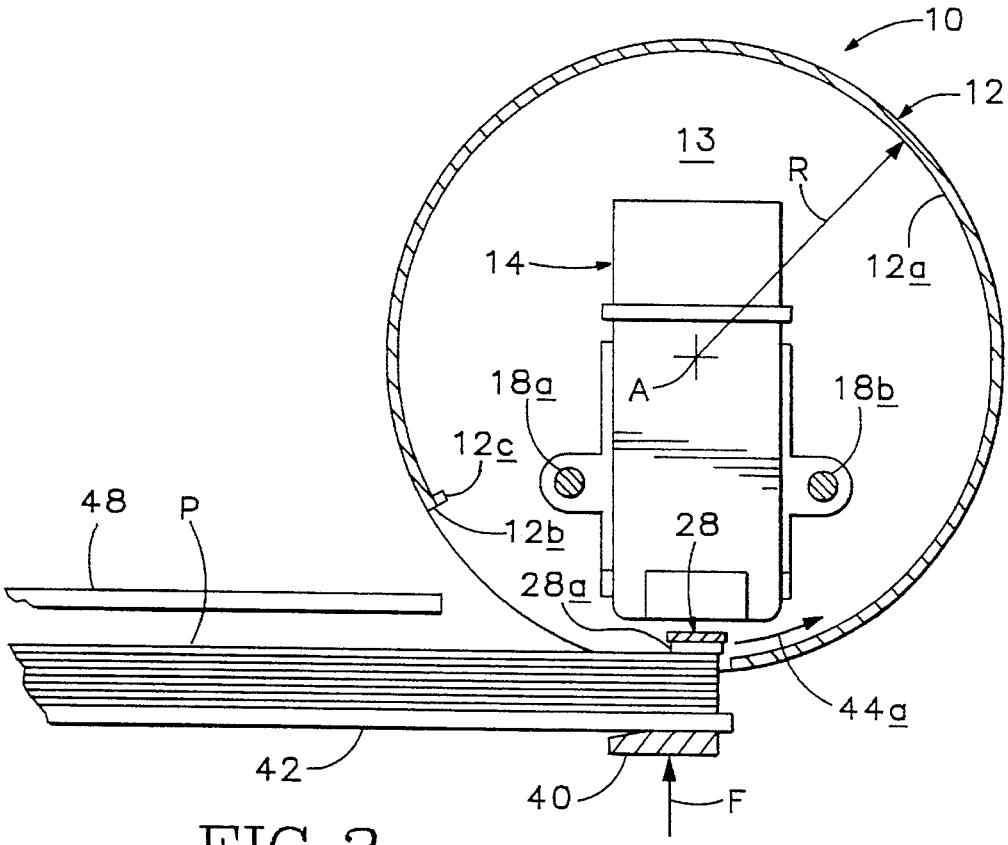
FIG. 3 is a sectional side view of the system of FIG. 1, the system being depicted during initial pick-up of a sheet of medium.

It should be evident that in order to provide the desired sheet support, the internal circumference of drum 12 should be greater than the sheet width (W), such width being representative of the maximum sheet width for the arrangement shown. Where the drum is cylindrical, the circumference may be represented by the product $2\pi R$, where R is the radius of the drum (see FIG. 3). Where the drum defines a slot, as is described herein, the drum's circumference should be great enough to support sheet P without obstructing the slot.

Focusing now on the sheet advancing mechanism, and referring still to FIGS. 1 and 2, it will be noted that the mechanism's grip member 28 is mounted for movement along the drum's interior surface, movement being achieved via a bearing arrangement which includes a motor 30, a frictional gear 30*a*, and a pair of rings 32 (one of which is driven by the gear). As best shown in FIG. 2, the system's grip member is mounted on the rings, the rings, in turn, tiding on ball bearings 26, 34. The ball bearings also form a part of the beating arrangement which is now being described. Bearings 26 allow for independent movement of the drum and the grip member, and beatings 34 allow for movement of the rings relative to a pair of end caps 36 which are mounted on the system's chassis 38. Those skilled in the an will appreciate that the depicted bearing arrangement could be modified by replacing the motor 30 and gear 30*a* with a suitable ratchet mechanism for use in combination with motor 22 (which drives drum 12).

As previously described, grip member 28 is mounted on rings 32, the grip member being directed along the drum's interior surface by movement of the tings. In the preferred embodiment, the grip member includes a frictional shoe 28*a* and an elongate blade 28*b*. Referring to FIGS. 1 and 2, it is to be noted that the blade extends lengthwise across the drum's interior, opposite ends of the blade being secured to opposite rings 32. Although the blade is configured to travel along interior surface 12*a*, it is spaced therefrom to allow passage of the blade past a pair of stops 12*c* which extend into the drum's interior so as to restrict passage of sheet P. Shoe 28*a* extends from the blade to pinch sheet P against the drum's interior surface during sheet advancement as will be described below. As best indicated in FIG. 1, shoe 28*a* extends toward the drum's interior surface in a longitudinal region between the stops 12*c* so as to avoid obstruction of passage of the shoe during rotation of the grip member relative to the drum.

Attention will now be given to the particulars of sheet media throughput, the throughput of a sheet P being illustrated in FIGS. 3 through 6. Beginning with FIG. 3, it is to be noted that during sheet pick-up, the drum is oriented in a pick-up orientation, slot 12*b* being correspondingly positioned to accommodate intake of sheet P. Sheet P is at the top of an input stack, the stack being raised above (as viewed in FIG. 3) its nominal position by a lifter 40 which acts upon the system's input tray 42. Force arrow F illustrates the force which acts on the lifter to raise the stack to a position wherein the top sheet P contacts frictional shoe 28*a*. The grip member, and thus the frictional shoe, is moved by motor 30 in a first rotational direction indicated by arrow 44*a* so as to pull sheet P from the stack and into the drum. Initially a leading edge of sheet P is pinched between the shoe and the sheet stack (FIG. 3), but as the shoe is passed over the interior surface of the drum (FIG. 4), the interior surface provides opposition to the shoe. The lifter may thus be lowered as shown in FIG. 2.

Figure 4:
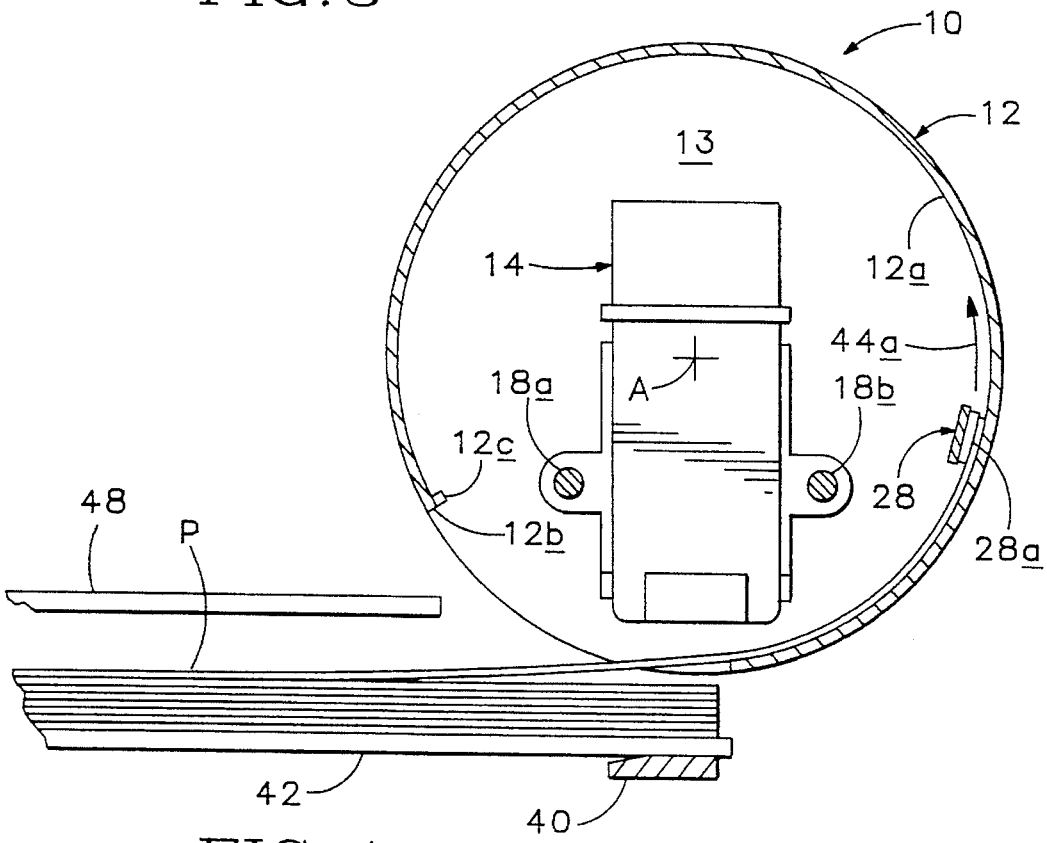
FIG. 4 is a sectional side view similar to that of FIG. 3, the system being depicted after initial pick-up, during insertion of the sheet into the drum.

The sheet is pulled along the interior of the drum as shown in FIG. 4 until the sheet's leading edge contacts stops 12*c*. The stops extend into the drum's interior so as to restrict sheet passage, but allow passage of the grip member. The grip member thus continues its rotation until the shoe contacts the sheet's trailing edge, such contact providing a pinching effect between the sheets leading and trailing edges which urges the sheet to contact the interior surface 12*a*. It is to be noted that the grip member advances only to the trailing edge of the sheet and is then locked in position relative to the drum. In the preferred embodiment, the distance of such rotation is determinable by apparatus such as an optical sensor (not shown) which identifies the sheet's trailing edge and correspondingly directs operation of motor 30 (via a processor) to halt movement of the grip member relative to the drum.

Figure 5:
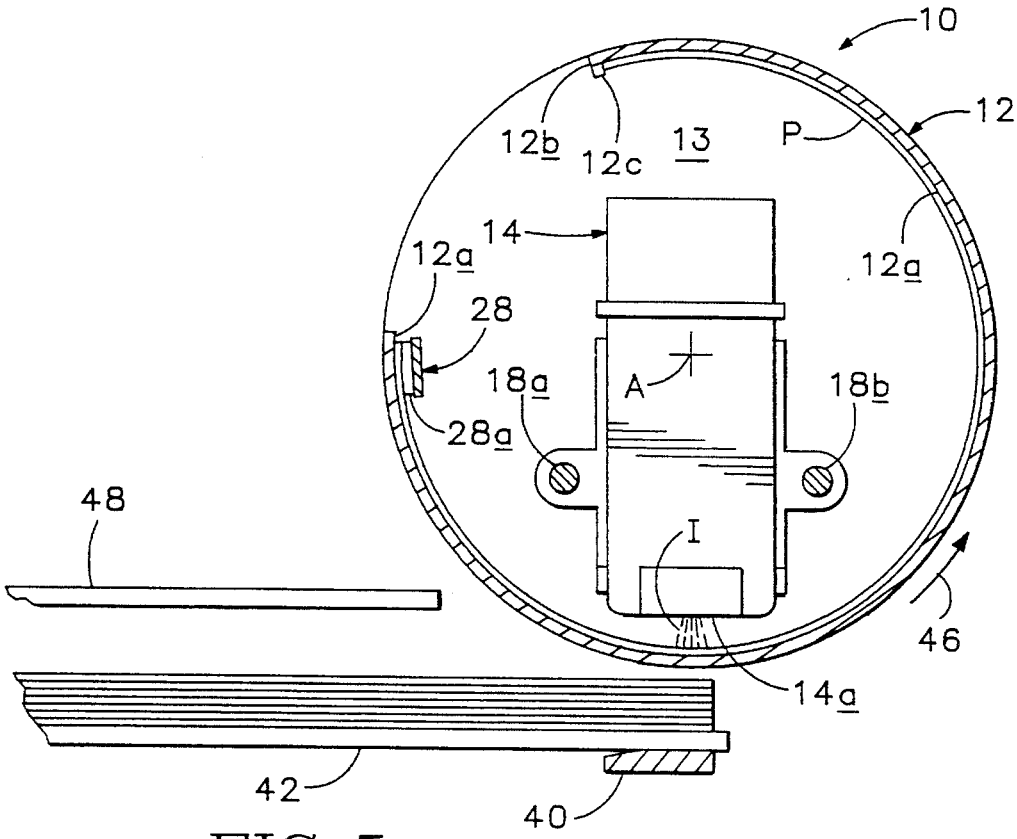
FIG. 5 is a sectional side view similar to that of FIGS. 3 and 4, the system being depicted during marking of an inserted sheet.

Once the sheet has been pulled entirely into the drum, and the grip member has been locked in place relative to the drum, the drum begins rotation in the direction indicated by arrow 46 in FIG. 5. The grip member rotates with the drum, holding the sheet P in a fixed position relative to the drum. The sheet is thus rotated about printhead 14, the printhead being directed to produce markings on the sheet in a rotationally defined print swath as the sheet passes thereby. In the preferred embodiment, ink-jet printhead 14 propels ink (I) onto the sheet.

Figure 6:
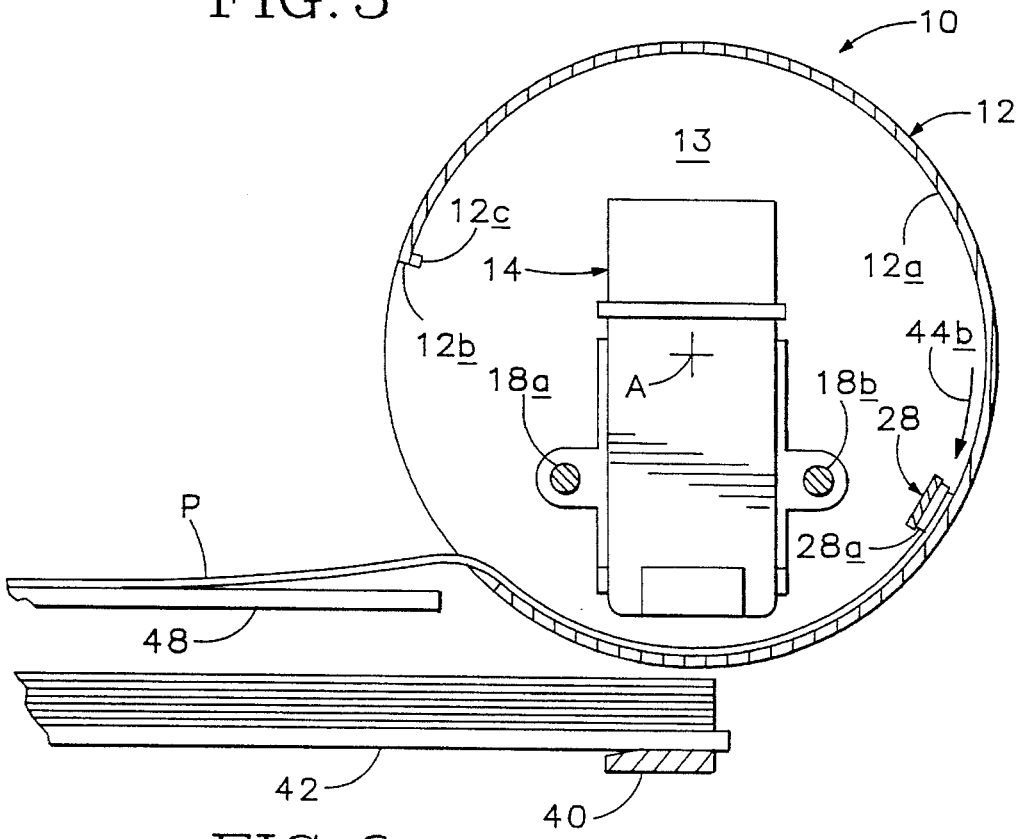
FIG. 6 is a sectional side view as in FIGS. 3, 4 and 5, the system being depicted during expulsion of a printed sheet.

After the entire sheet has been printed, grip member 28 is released from its association with the drum, and the drum is rotated in a direction opposite to the previously-indicated direction of arrow 46 to orient the drum in sheet the expulsion orientation shown in FIG. 6. The sheet expulsion orientation, it will be appreciated, places slot 12*b* such that sheet P will be passed onto an output tray 48 upon expulsion from the drum. Sheet expulsion is then achieved by moving the grip member in a second rotational direction indicated by arrow 44*b*, the second rotational direction being opposite to the previous direction of grip member rotation. The grip member engages the trailing edge of the sheet, urging the sheet through slot 12*b* and onto an output tray 48.

Industrial Applicability

As will be appreciated by those skilled in the art, the invented sheet media marking system provides a low cost solution for use in the marking of sheet media, whether it be in a printer, a copier, or in another sheet marking device. The system offers increased sheet media throughput, decreased power requirements, and decreased vibration and noise relative to previously known systems. The system achieves these improvements by minimizing reciprocation of the system's marker, the system providing an arrangement whereby the marker need only be moved in a single direction during printing on a given sheet.

Although a preferred embodiment of the present invention has been shown and described in the context of an ink-jet printer, it will be appreciated by those skilled in the art that changes in form and detail may be made without departing from the spirit and scope of the invention as defined by the appended claims.

I claim:

1. A sheet media marking system which comprises:

a rotatable drum having a slot through which the sheet medium is inserted and expelled, and an arcuate interior surface configured to support the sheet medium in a corresponding arcuate shape;

a printhead within said drum, said printhead being capable of producing markings on the sheet medium;

a printhead support which resides within said rotatable drum, said support being arranged to hold said printhead in a predetermined rotational orientation;

a media advancement mechanism in operative relation with said drum, said mechanism including a movable shoe capable of gripping the sheet medium and directing the sheet medium through a predetermined sheet medium path; and a drum drive operatively connected to said drum to effect selected rotation of said drum about a first axis, and thus rotation of the sheet medium about said printhead to accommodate marking of the sheet medium in a print swath defined by a rotation of said drum.

2. The system of claim 1, wherein said printhead support includes a carriage which holds said printhead, said carriage being configured for graduated movement along a track parallel to said first axis.

3. The system of claim 2, wherein each graduated movement of said carriage provides for a separate rotationally-defined print swath.

4. The system of claim 2, wherein said printhead support includes a screw drive in operative relation to said carriage to direct movement of said carriage along said track.

5. The system of claim 1, wherein said shoe is coupled with said drum via a bearing arrangement which allows for movement of said shoe along the interior surface of said drum to direct corresponding movement of the sheet medium.

6. The system of claim 5, wherein said bearing arrangement accommodates bi-directional movement of said shoe, movement of said shoe in a first direction effecting insertion of the sheet medium into said drum, and movement in a second direction effecting expulsion of the sheet medium from said drum.

7. The system of claim 6, wherein said drum includes a stop which restricts passage of the sheet medium, but allows passage of said shoe.

8. The system of claim 7, wherein said stop is positioned to limit insertion of the sheet media by engagement with the sheet's leading edge upon a predetermined movement of the sheet medium in said first direction, said shoe being capable of continued movement in said first direction to engage the sheet's trailing edge to tension the sheet medium between said stop and said shoe, urging the sheet medium against the interior surface of said drum.

9. In a sheet media marking system which defines a path along which a sheet medium passes, and which includes a marker and an opposing sheet-supporting platen operatively mounted on a system chassis, a medium advancing mechanism which comprises:

a grip member including a generally planar blade which extends across the sheet medium path, and a shoe projecting from said blade and including a frictional surface capable of gripping the sheet medium which is to be moved along the sheet medium path; and a bearing arrangement operatively interposed the system chassis and said grip member to provide for movement of said grip member, and thus the sheet medium, along the sheet medium path.

10. The system of claim 9, wherein said bearing arrangement accommodates bi-directional movement of said grip member along the sheet medium path, movement of said grip member in a first direction effecting placement of the sheet medium onto the platen, and movement in a second direction effecting removal of the sheet medium from the platen.

11. The system of claim 9, wherein the platen is defined by a concave arcuate surface which at least partially defines an elliptical sheet medium path, the platen including a stop which restricts passage of the sheet medium, but allows passage of said gripping member.

12. The system of claim 11, wherein said stop is positioned to limit insertion of the sheet medium by engagement with the sheet's leading edge upon a predetermined movement of the sheet medium in a first direction, said grip member being capable of a predetermined movement in the first direction to engage the sheet's trailing edge to urge the sheet medium against the arcuate surface of the platen.

13. The system of claim 12, wherein the arcuate platen is configured for rotation about the marker.

14. The system of claim 13, which further includes a platen drive operatively connected to the platen to effect selected rotation of the platen about its axis of rotation, and thus rotation of the sheet medium supported by the platen about the printhead to accommodate marking of the sheet medium in a swath defined by a rotation of the platen.

15. The system of claim 14, which further includes a marker support arranged to hold the marker in a predetermined rotational orientation, but allow graduated movement of the marker along an axis parallel to the axis of platen rotation, each graduated movement of the marker accommodating marking of the sheet medium in a separate swath.

* * * * *